US009797217B2

(12) United States Patent
Flores et al.

(10) Patent No.: US 9,797,217 B2
(45) Date of Patent: Oct. 24, 2017

(54) THERMAL MEMORY SPACING SYSTEM

(71) Applicant: Baker Hughes Incorporated, Houston, TX (US)

(72) Inventors: Juan Carlos Flores, The Woodlands, TX (US); Rostyslav Dolog, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 417 days.

(21) Appl. No.: 14/553,536

(22) Filed: Nov. 25, 2014

(65) Prior Publication Data

US 2016/0145963 A1 May 26, 2016

(51) Int. Cl.
*E21B 33/124* (2006.01)
*E21B 17/00* (2006.01)

(52) U.S. Cl.
CPC ..... *E21B 33/124* (2013.01); *E21B 17/00* (2013.01)

(58) Field of Classification Search
None
See application file for complete search history.

(56) References Cited

U.S. PATENT DOCUMENTS 4,515,213 A 5/1985 Rogen et al.
2004/0197519 A1* 10/2004 Elzey ..... B32B 3/28 428/68
2006/0124304 A1 6/2006 Bloess et al.
2007/0235194 A1* 10/2007 Maier ..... E21B 33/124 166/305.1
2013/0126151 A1 5/2013 Xu
2013/0277068 A1* 10/2013 Richard ..... E21B 33/1208 166/387
2014/0027108 A1* 1/2014 Lopez ..... E21B 43/108 166/248
2014/0027120 A1 1/2014 Clark et al.
2014/0138088 A1 5/2014 Ramon
2014/0262290 A1* 9/2014 Bussear ..... E21B 33/124 166/308.1

OTHER PUBLICATIONS

The International Bureau of WIPO; International Preliminary Report on Patentability for Application No. PCT/US2015/060666 dated Jun. 8, 2017.

* cited by examiner

*Primary Examiner* — Caroline Butcher
(74) *Attorney, Agent, or Firm* — Parsons Behle & Latimer

(57) ABSTRACT

A packer having a thermal memory spacing system that includes a portion of the system that that selectively changes an outer diameter due. The packer may include upper and lower sealing elements, and at least one thermal memory shape material sub positioned between the sealing elements. The thermal memory shape material sub may have a first outer diameter at a first temperature and a second larger outer diameter at a second temperature. The first temperature may be greater than the second temperature. The outer diameter of the sub may be selectively increased to temporarily decrease the annular area in which debris and/or materials may collect and potentially cause the packer to become stuck within the wellbore. Prior to moving the packer to a different location, the outer diameter of the sub may be decreased to increase the annular area.

21 Claims, 5 Drawing Sheets

THERMAL MEMORY SPACING SYSTEM

FIELD OF THE DISCLOSURE

The embodiments described herein relate to a packer having a thermal memory spacing system that includes a portion of the system that that changes the outer diameter due to temperature and method of using the thermal memory spacing system.

BACKGROUND

Description of the Related Art

Packing devices, such as straddle packers, may be conveyed into a wellbore to be used to selectively isolate a portion of the wellbore. The isolation of a portion of the wellbore may be done for various reasons such as treating and/or fracturing the formation adjacent to the casing of the portion being isolated by the packer. While the packer is set against the casing it is quite common for debris and/or material to accumulate in the annulus between the packer and the casing as well as above the packer. In some instances, the accumulation of debris and/or material can cause it to be difficult to unset the packer when the treatment process has finished. Further, the debris and/or material can cause the packer to become stuck within the wellbore, not permitting the packer to be moved to another location within the wellbore.

SUMMARY

The present disclosure is directed to a packer that includes a thermal memory sub and method of using the thermal memory sub that overcomes some of the problems and disadvantages discussed above.

One embodiment is a packer comprising an upper sealing element, a lower sealing element, and a first sub positioned between the upper and lower sealing elements, the first sub being comprised of a memory shape material. At a first temperature the first sub has a first outer diameter and at a second temperature the first sub has a second outer diameter, the second outer diameter being larger than the first outer diameter.

The first temperature may be greater than the second temperature. The packer may include a fluid displacement sub positioned between the upper and lower sealing elements, the fluid displacement sub may have at least one port that permits fluid communication between an interior of the fluid displacement sub and an exterior of the fluid displacement sub. The packer may comprise a second sub positioned between the upper and lower sealing element, the second sub may be comprised of a memory shape material. The second sub may have a first outer diameter at the first temperature and may have a second outer diameter at the second temperature. The second outer diameter of the second sub may be larger than the first outer diameter. The fluid displacement sub may be positioned between the first sub and the second sub. The packer may comprise a third sub positioned above the upper sealing element. The third sub may be comprised of a memory shape material and may have a first outer diameter at the first temperature and may have a second outer diameter at the second temperature. The second diameter of the third sub may be larger than the first diameter. The first temperature may be greater than the second temperature.

The memory shape material may be a memory shape alloy. The memory shape alloy may be nickel titanium alloy, nickel titanium zirconium alloy, titanium nickel copper alloy, copper aluminum manganese alloy, iron nickel cobalt aluminum tantalum boron alloy, copper aluminum niobium alloy, nickel manganese gallium alloy, zirconium copper alloy, polycrystalline iron nickel cobalt aluminum alloy, polycrystalline iron manganese aluminum nickel alloy, polycrystalline nickel titanium zirconium niobium alloy, or combination thereof. The memory shape material may be a memory shape polymer. The first temperature may be at least approximately five degrees Fahrenheit greater than the second temperature. The second diameter of the first sub may be at least 5% larger than the first diameter of the first sub.

One embodiment is a method of treating a portion of a wellbore. The method comprises positioning a packer connected to a tubing string adjacent a first portion of a wellbore, the packer comprising an upper sealing element, a lower sealing element, a fluid displacement sub, and at least one sub comprised of a memory shape material having a first outer diameter at a first temperature and having a second outer diameter at a second temperature. The fluid displacement sub and the at least one sub each positioned between the upper and lower sealing elements. The method comprises actuating the upper and lower sealing elements to selectively isolate the first portion of the wellbore and treating the first portion of the wellbore. The method comprises changing a temperature of the isolated first portion of the wellbore to the second temperature, wherein the at least one sub as the second outer diameter which is different than the first outer diameter.

The second outer diameter of the at least one sub may be larger than the first outer diameter of the at least one sub. Treating the first portion of the wellbore may comprise pumping fluid down the tubing string and out the fluid displacement sub. Treating the first portion of the wellbore may comprise fracturing a formation by pumping fluid down the tubing string and out the fluid displacement sub. The formation may have been previously fractured and the formation may be re-fractured by the treatment.

The method may include changing the temperature of the isolated first portion of the wellbore to the first temperature after treating the first portion of the wellbore, wherein the at least one sub moves to the first outer diameter. The method may include unsetting the upper and lower sealing elements and moving the packer to a second portion of the wellbore. The at least one sub may have the first outer diameter as it is positioned adjacent to the first portion of the wellbore. The at least one sub may comprise a first sub positioned above the fluid displacement sub and a second sub positioned below the fluid displacement sub, wherein the first and second subs are both positioned between the upper and lower sealing elements. The method may include changing a temperature of the isolated first portion of the wellbore to the second temperature, which may actuate the first and second subs to their second outer diameters being larger than their first outer diameters. The method may include changing the temperature of the isolated first portion of the wellbore to the first temperature after treating the first portion of the wellbore, wherein the first temperature actuates the first and second subs to their first outer diameters being smaller than their second outer diameters.

Figure 1:
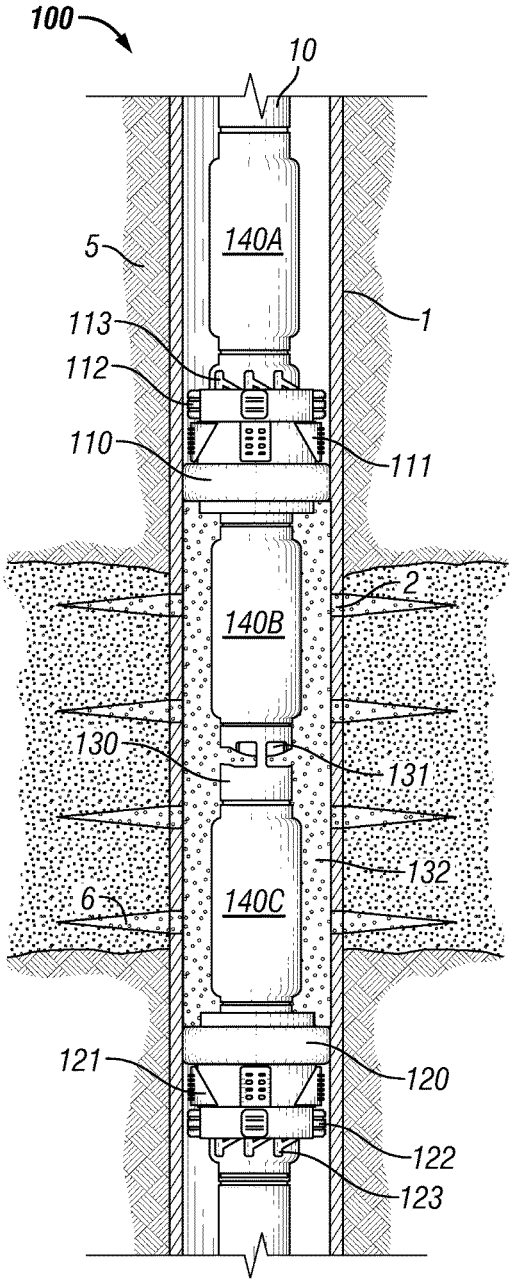
FIG. 1 shows an embodiment of a packer having thermal memory subs isolating and treating a portion of a wellbore.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows an embodiment of a packer 100 having thermal memory subs 140A, 140B, and 140C positioned within a wellbore. The packer 100 may be connected to a tubing string 10 and run into a wellbore, which may include a casing 1. The packer 100 may be positioned adjacent to perforations 2 in the casing 1 that permits fluid communication with the adjacent formation 5 and the wellbore. The formation 5 may be fractured 6 adjacent the perforations 2 in an attempt to increase the production of hydrocarbons from the formation 5.

The packer 100 may include an upper sealing element 110, upper slips 111, upper blocks 112, and an upper j-slot track 113. The upper sealing element 110 may be set against the casing 1 to create a seal, as shown. The packer 100 may include a lower sealing element 120, lower slips 121, lower blocks 122, and a lower j-slot track 123. The lower sealing element 120 may be set against the casing 1 to create a seal, as shown. The packer 100, including the various components, is for illustrative purposes only as various downhole packers may be used in connection with the thermal memory subs 140A, 140B, and 140C disclosed herein. The upper and lower sealing elements 110 and 120 may be used to isolate a portion of the wellbore. The packer 100 may include a fluid displacement sub 130 with a port 131 or plurality of ports 131 that permit fluid communication from the tubing string 10 to the exterior of the fluid displacement sub 130. The fluid displacement sub 130 may be connected between two thermal memory subs 140B and 140C.

The thermal memory subs 140A, 140B, and 140C are configured so that the exterior of the subs 140A, 140B, and 140C is comprised of a memory shape material that changes shape depending on the temperature. The thermal memory subs 140A, 140B, and 140C may be configured so that the subs 140A, 140B, and 140C have a first smaller outer diameter at a first temperature and have a second larger outer diameter at a second temperature. The second diameter may be approximately 10%, or more, larger or than the first diameter. However, the actual change in diameters may be configured based on the intended application. For example, a 5%, or even less, change in diameter may be sufficient in certain circumstances. The subs 140A, 140B, and 140C may be comprised of various materials as would be appreciated by one of ordinary skill in the art having the benefit of this disclosure. The memory shape material may be comprised of a memory shape alloy. For example, the subs 140A, 140B, and 140C may be comprised of, but not limited to, nickel titanium alloy, nickel titanium zirconium alloy, titanium nickel copper alloy, copper aluminum manganese alloy, iron nickel cobalt aluminum tantalum boron alloy, copper aluminum niobium alloy, nickel manganese gallium alloy, zirconium copper alloy, polycrystalline iron nickel cobalt aluminum alloy, polycrystalline iron manganese aluminum nickel alloy, and polycrystalline nickel titanium zirconium niobium alloy. Alternatively, the sub 140 may be comprised of a memory shape polymer that permits the actuation between different shapes as would be appreciated by one or ordinary skill in the art having the benefit of this disclosure.

At a first temperature, the outer diameter of the thermal memory subs 140A, 140B, and 140C may be smaller than the outer diameter of the thermal memory subs 140A, 140B, and 140C at a second temperature. The first temperature may be hotter than the second temperature. In one embodiment, there may be at least a 5 degree Fahrenheit difference between the first and second temperatures. However, the difference between the first and second temperatures may be larger than 5 degrees Fahrenheit. For example, the difference between the first and second temperatures may be 10, 20, 25, 50, or more degrees Fahrenheit. As the temperature of the thermal memory subs 140A, 140B, and 140C decreases the outer diameter of the thermal memory subs 140A, 140B, and 140C may increase. FIG. 1 shows the packer 100 positioned within the wellbore during treatment of the first portion of the wellbore, which may represent the second temperature. Thus, the outer diameter of the subs 140A, 140B, and 140C is increased presenting less annular area between the subs 140A, 140B, and 140C and the casing 1. A smaller annular area between the subs 140A, 140B, and 140C and the casing 1 may provide less area for the buildup of debris within the wellbore. As discussed herein, the later decrease in the outer diameter of the subs 140A, 140B, and 140C may reduce the chance that the packer 100 becomes stuck within the wellbore as it is unset and attempted to be moved to another location. The treatment pumped through the port 131 of the fluid diversion sub 130 may comprise the injection of fluid into the formation or the fracturing, or re-fracturing, of a formation 5 adjacent the portion of the wellbore isolated by the sealing elements 110 and 120 of the packer 100.

Figure 2:
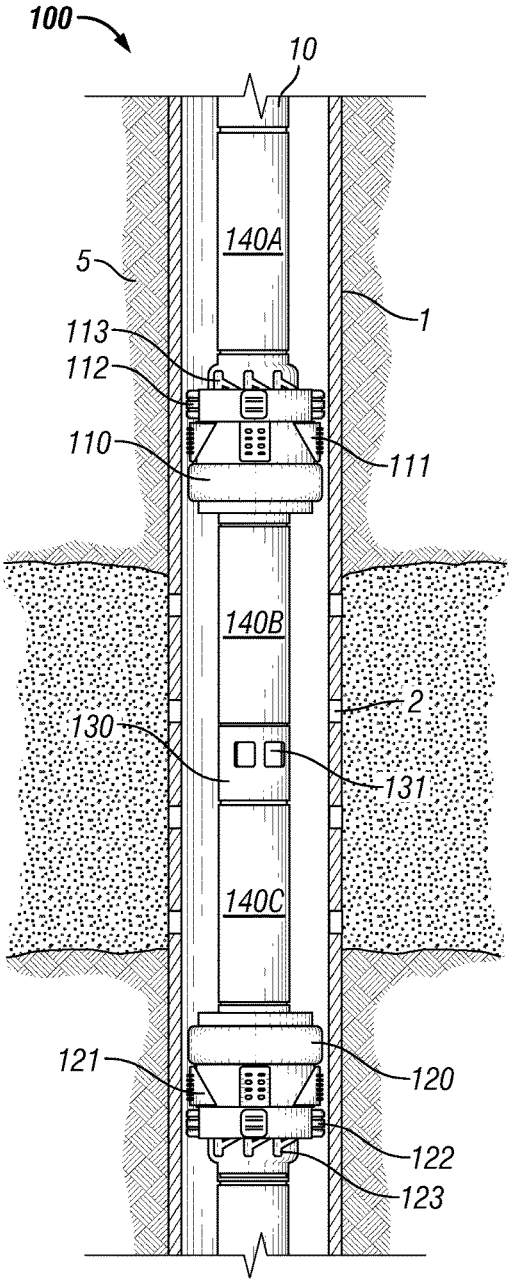
FIG. 2 shows an embodiment of a packer having thermal memory subs positioned within a wellbore.

Once the treatment of the wellbore is completed, the temperature of the thermal memory subs 140A, 140B, and 140C may raise to normal well temperatures, which may represent the first temperature. Thus, the outer diameter of the thermal memory subs 140A, 140B, and 140C decreases enlarging the annular area between the subs 140A, 140B, and 140C and the casing 1 as shown in FIG. 2. This enlarged area, in comparison to the annular area during the treatment process, may reduce the chance that the packer 100 will become stuck within the wellbore due to debris between the packer 100 and the casing 1. The packer 100 may include a thermal memory sub 140A above the upper sealing element 110 as well as multiple thermal memory subs 140B and 140C between the upper and lower sealing elements 110 and 120. The packer 100 could also include a thermal memory sub below the lower sealing element 120, if desired. The number and configuration of the thermal memory subs 140A, 140B, and 140C is for illustrative purposes only and may be varied as would be appreciated by one of ordinary skill in the art having the benefit of this disclosure. The thermal memory sub 140 provides a smaller annular area for the buildup of debris between the packer 100 and casing 1 during the treatment of the wellbore. The thermal memory sub 140 then provides a larger annular area when the packer 100 is to be unset and moved within the wellbore decreasing the likelihood that debris will cause the packer 100 will become stuck within the casing 1.

Figure 3:
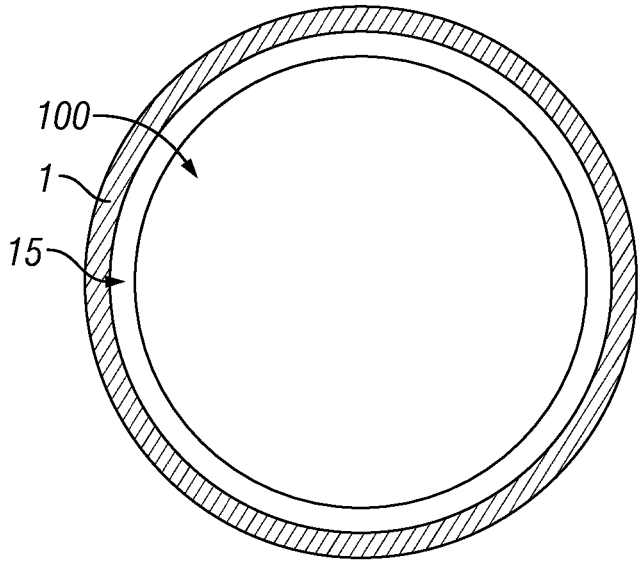
FIG. 3 shows a cross-section of a portion of one embodiment of a packer with a thermal memory sub in an expanded state within a wellbore.
Figure 4:
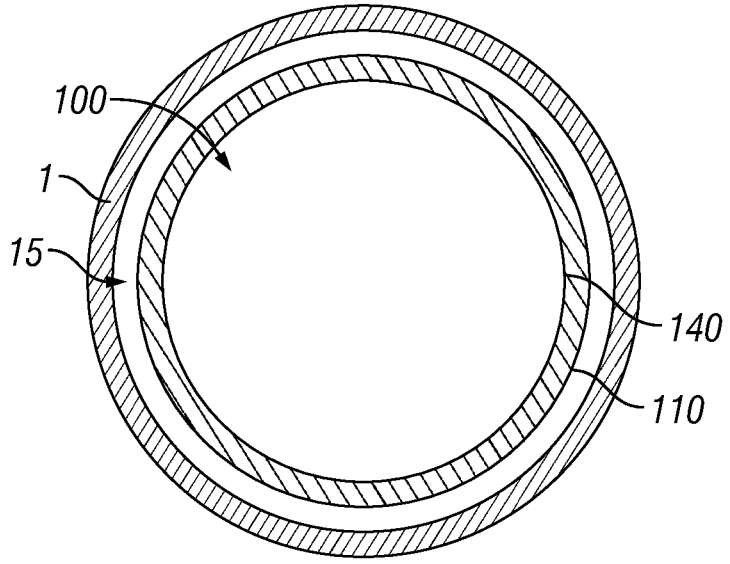
FIG. 4 shows a cross-section of a portion of a one embodiment of a packer with a thermal memory sub in a contracted state within a wellbore.

FIG. 3 and FIG. 4 shows a cross-section view of a packer 100 positioned within casing 1 of a wellbore. In FIG. 3, the packer 100 is at a first or lower temperature and the packer is at a second or higher temperature in FIG. 4. In FIG. 4, the outer diameter of the thermal memory sub 140 has contracted due to the movement of memory shape material so that the annular area 15 between the casing 1 and the sub 140 is larger in comparison to the annular area 15 of FIG. 3.

Figure 5:
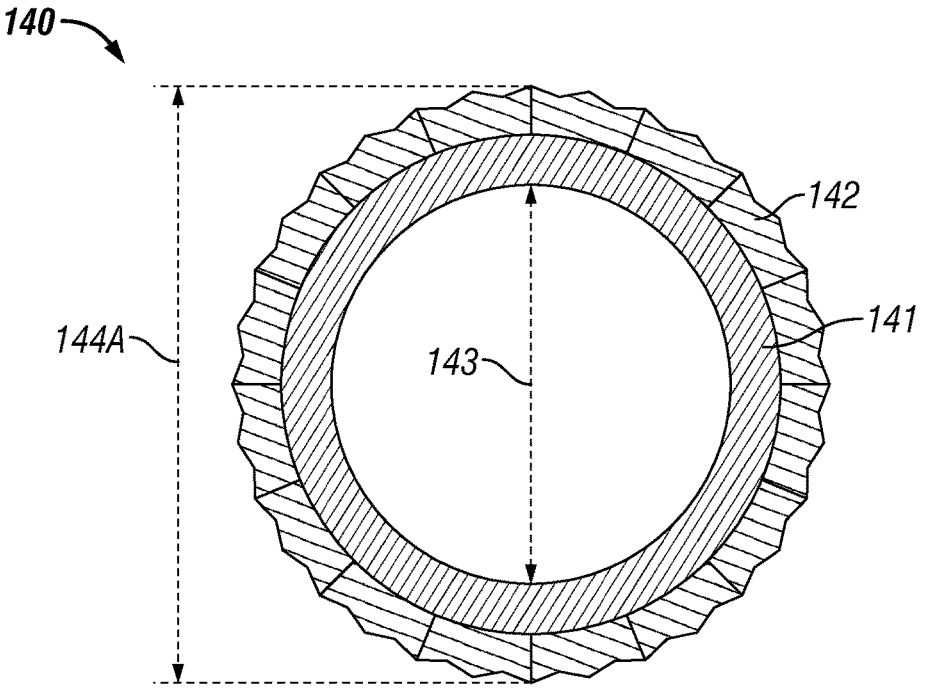
FIG. 5 shows a cross-section of a portion of one embodiment of a thermal memory sub in an expanded state.
Figure 6:
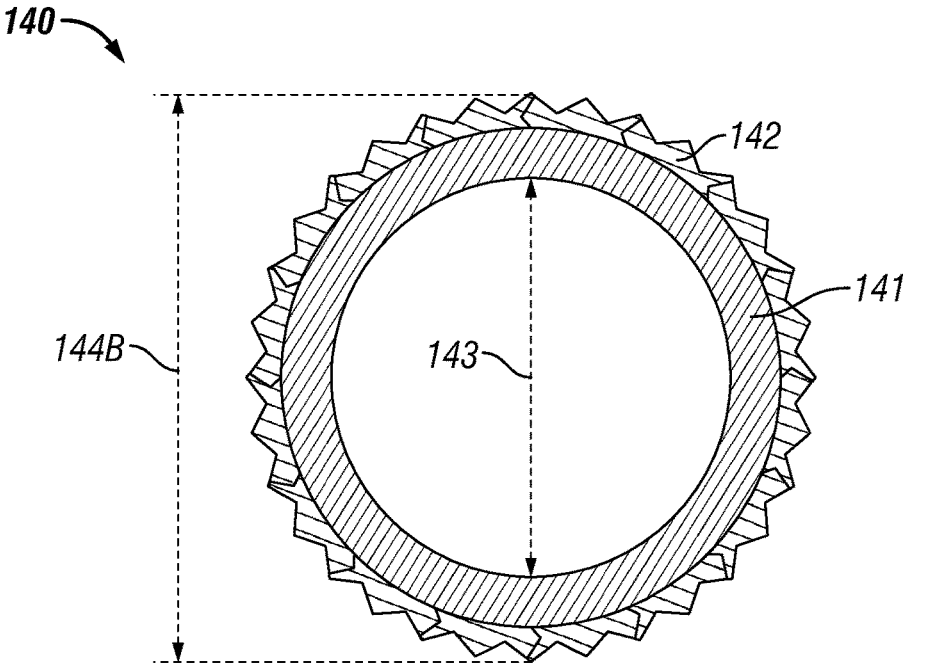
FIG. 6 shows a cross-section of a portion of one embodiment of a thermal memory sub in a contracted state.

FIG. 5 and FIG. 6 show a cross-section view of an embodiment of a thermal memory sub 140 having a core 141 and a memory shape material 142 positioned around the core 141. The core 141 may have an inner diameter 143. FIG. 5 shows the thermal memory sub 140 at a first or lower temperature at which the thermal memory sub 140 has an outer diameter 144A. FIG. 6 shows the thermal memory sub 140 at a second or higher temperature at which the outer diameter 144B has reduced in comparison to the outer diameter of FIG. 5. The inner diameter 143 of the core 141 does not change significantly in either the first or second temperatures. FIG. 6 shows one embodiment on the potential change in shape of the memory shape material 142 to reduce the overall outer diameter of the thermal memory sub 140.

Figure 7:
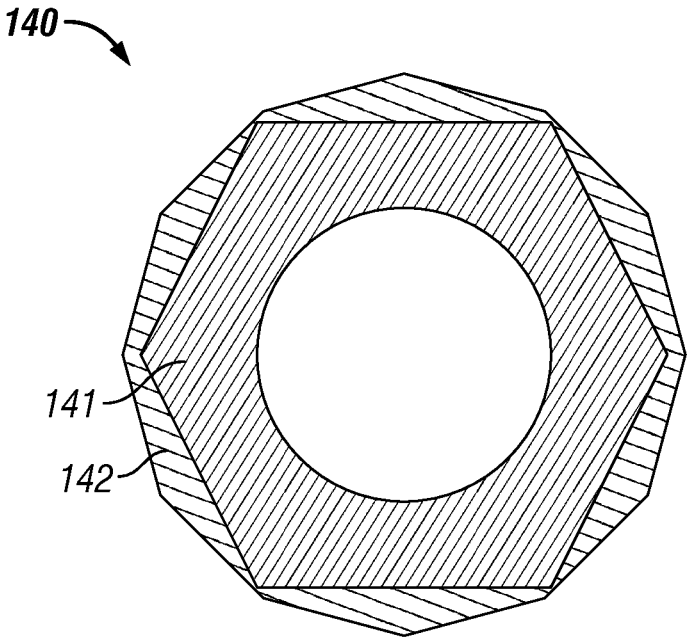
FIG. 7 shows a cross-section of a portion of one embodiment of a thermal memory sub in an expanded state.
Figure 8:
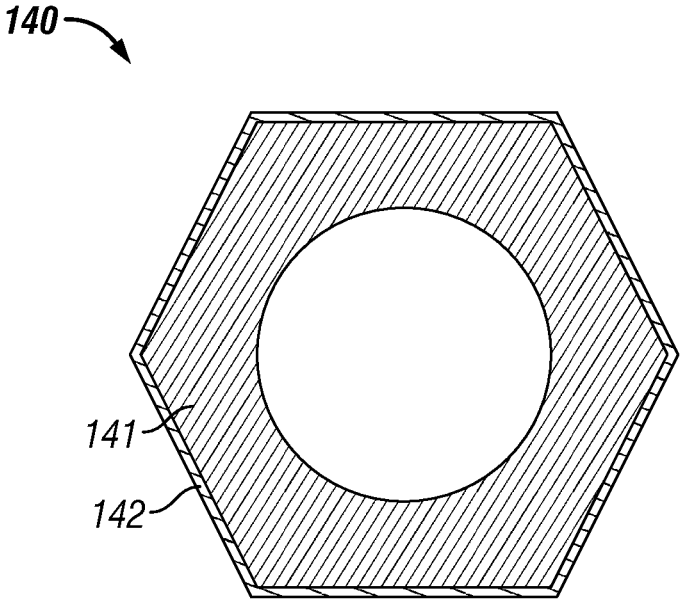
FIG. 8 shows a cross-section of a portion of one embodiment of a thermal memory sub in a contracted state.

FIG. 7 and FIG. 8 show a cross-section view of an embodiment of a thermal memory sub 140 having a core 141 and a memory shape material 142 positioned around the core 141. FIG. 7 shows the thermal memory sub 140 at a first or lower temperature so that the memory shape material 142 extends away from the core 141 to increase the outer diameter or outer perimeter of the sub 140. FIG. 8 shows the thermal memory sub 140 at a second or higher temperature at which the memory shape material 142 contracts towards the core 141 reducing the outer diameter in comparison to the outer diameter of FIG. 7.

Figure 9:
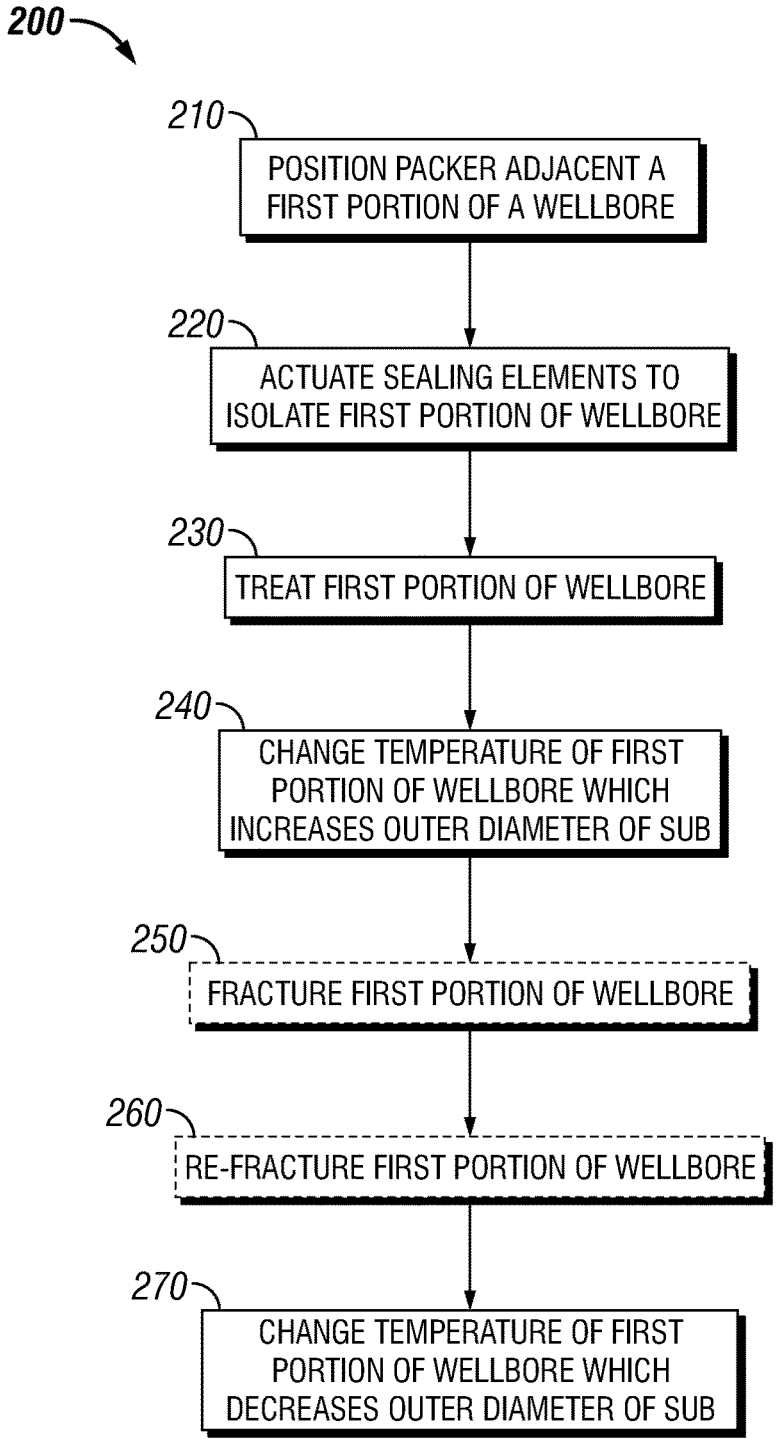
FIG. 9 shows a flow chart of an embodiment of a method of treating a portion of a wellbore.

FIG. 9 shows a flow chart of one embodiment of a method 200 of treating a portion of a wellbore. The first step 210 is positioning a packer adjacent a first portion of the wellbore. The sealing elements of the packer are actuated to isolate the first portion of the wellbore in step 220. The first portion of the wellbore is treated in step 230 and the temperature of the first portion of the wellbore is changed during the treatment process in step 240. For example, the temperature may be lowered during the treatment process. However, the temperature could instead be raised during the treatment process. Optionally the treatment of the wellbore may comprise fracturing the wellbore in step 250 or re-fracturing the portion of the wellbore in step 260 if the wellbore has already been previously fractured. The changing of the temperature in step 240, which is done contemporaneously with the treatment of the wellbore in step 230, causes the increasing of an outer diameter of at least a portion, such as a sub comprised of a memory shape material, of the packer. Upon finishing the treatment process 230 of the wellbore, the temperature of the first portion of the wellbore is changed again in step 270. For example, the temperature may be increased causing a reduction in an outer diameter of at least the portion of the packer, such as the sub comprises of the memory shape material. Alternatively, a reduction in the temperature may cause the reduction in an outer diameter of at least a portion of the packer. Treating the wellbore with the sub having a larger diameter reduces the annular area between the sub and the wellbore decreasing the amount of debris and other material that may collect in this area. After treating the wellbore has finished and the temperature increases, the outer diameter of the sub will reduce enlarging the annular area, which will decrease the chance that the packer will become stuck due to the debris within the annular area adjacent the sub.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A packer comprising:

an upper sealing element configured to be engaged against a wellbore;

a lower sealing element configured to be engaged against the wellbore; and a first sub positioned between the upper and lower sealing elements, the first sub comprised of a memory shape material;

wherein at a first temperature the first sub has a first outer diameter and wherein at a second temperature the first sub has a second outer diameter, the second outer diameter being larger than the first outer diameter and wherein the first temperature is greater than the second temperature, and wherein the first sub does not contact a portion of the wellbore while having the second diameter.

2. The packer of claim 1, further comprising a fluid displacement sub positioned between the upper and lower sealing element, the fluid displacement sub having at least one port that permits fluid communication between an interior of the fluid displacement sub and an exterior of the fluid displacement sub.

3. The packer of claim 2, further comprising a second sub positioned between the upper and lower sealing elements, the second sub comprised of the memory shape material, wherein at the first temperature the second sub has a first outer diameter and wherein at the second temperature the second sub has a second outer diameter, the second outer diameter being larger than the first outer diameter, and wherein the fluid displacement sub is positioned between the first sub and the second sub.

4. The packer of claim 3, further comprising a third sub positioned above the upper sealing element, the third sub comprised of the memory shape material, wherein at the first temperature the third sub has a first outer diameter and wherein at the second temperature the third sub has a second outer diameter, the second outer diameter being larger than the first outer diameter.

5. The packer of claim 4, wherein the memory shape material comprises a memory shape polymer.

6. The packer of claim 4, wherein the memory shape material comprises a memory shape alloy.

7. The packer of claim 6, wherein the memory shape alloy is nickel titanium alloy, nickel titanium zirconium alloy, titanium nickel copper alloy, copper aluminum manganese alloy, iron nickel cobalt aluminum tantalum boron alloy, copper aluminum niobium alloy, nickel manganese gallium alloy, zirconium copper alloy, polycrystalline iron nickel cobalt aluminum alloy, polycrystalline iron manganese aluminum nickel alloy, polycrystalline nickel titanium zirconium niobium alloy, or a combination thereof.

8. The packer of claim 4, wherein the first temperature is at least approximately five degrees Fahrenheit greater than the second temperature.

9. The packer of claim 1, wherein the second diameter is at least 5% larger than the first diameter.

10. The packer of claim 1, wherein the first sub with the first outer diameter provides a first annular area between the first sub and a portion of the wellbore and wherein the first sub with the second outer diameter provides a second annular area between the first sub and the portion of the wellbore, the first annular area being larger than the second annular area.

11. A method of treating a portion of a wellbore comprising:

actuating upper and lower sealing elements of a packer connected to a tubing string and positioned adjacent to a first portion of the wellbore to selectively isolate the first portion of the wellbore, the packer comprising the upper sealing element, the lower sealing element, a fluid displacement sub, and at least one sub comprised of a memory shape material having a first outer diameter at a first temperature and having a second outer diameter at a second temperature, the fluid displacement sub and the at least one sub each positioned between the upper and lower sealing elements;

treating the first portion of the wellbore; and changing a temperature of the isolated first portion of the wellbore to the second temperature, wherein the at least one sub has the second outer diameter which is different than the first outer diameter, wherein there is a flow area between the first portion of the wellbore and the at least one sub comprised of memory shape material while the at least one sub has the second outer diameter.

12. The method of claim 11, wherein the second outer diameter is larger than the first outer diameter.

13. The method of claim 11, the treating the first portion of the wellbore comprises pumping fluid down the tubing string and out the fluid displacement sub.

14. The method of claim 13, the treating the first portion of the wellbore comprises fracturing a formation by pumping fluid down the tubing string and out the fluid displacement sub.

15. The method of claim 14, wherein the formation has been previously fractured and the formation is being refractured.

16. The method of claim 11, further comprising changing the temperature of the isolated first portion of the wellbore to the first temperature after treating the first portion of the wellbore, wherein the at least one sub moves to the first outer diameter.

17. The method of claim 16, further comprising unsetting the upper and lower sealing elements and moving the packer to a second portion of the wellbore.

18. The method of claim 11, the at least one sub has the first outer diameter as it is positioned adjacent the first portion of the wellbore.

19. The method of claim 11, wherein the at least one sub further comprises a first sub positioned above the fluid displacement sub and a second sub positioned below the fluid displacement sub, wherein the first and second subs are both positioned between the upper and lower sealing elements.

20. The method of claim 19, wherein changing the temperature of the isolated first portion of the wellbore to the second temperature actuates the first and second sub to their second outer diameters being larger than their first outer diameters.

21. The method of claim 20, further comprising changing the temperature of the isolated first portion of the wellbore to the first temperature after treating the first portion of the wellbore, wherein the first temperature actuates the first and second sub to their first outer diameters being smaller than their second outer diameters.

* * * * *